US005732517A

United States Patent [19]

Milikovsky

[11] Patent Number: 5,732,517

[45] Date of Patent: Mar. 31, 1998

[54] WINDOW STRUCTURE

[76] Inventor: Roman Milikovsky, 50 Palomino Dr., Bedford, N.H. 03110

[21] Appl. No.: 605,925

[22] Filed: Feb. 23, 1996

[51] Int. Cl.[6] ..... E06B 7/00

[52] U.S. Cl. ..... 52/171.3; 52/787.11; 52/172; 428/34

[58] Field of Search ..... 52/171.3, 172, 52/788.1, 786.1, 786.13, 787.11, 204.593, 204.595, 204.5; 428/34

[56] References Cited

U.S. PATENT DOCUMENTS 4,380,994 4/1983 Seemann ..... 52/171.3 X
4,829,729 5/1989 Derner et al. ..... 52/171.3
4,928,448 5/1990 Phillip ..... 52/786.13 X
5,269,108 12/1993 Fremaux ..... 52/171.3 X

*Primary Examiner*—Creighton Smith
*Attorney, Agent, or Firm*—Christopher Blank

[57] ABSTRACT

An improved thermally efficient window comprising a first structural glass pane with a first spacer means disposed between said first structural glass pane and an intermediate glass pane thus forming a first reservoir filled with a heat and sound insulating gas, a second structural glass pane and a second spacer means disposed to form a second reservoir with the intermediate glass panel, said second reservoir being filed with a heat conductive gas, and heating means disposed within the second reservoir.

7 Claims, 3 Drawing Sheets

STATE OF THE ART

STATE OF THE ART

WINDOW STRUCTURE

BACKGROUND OF THE INVENTION

Windows are typically one of the primary sources of heat loss in any architectural structure. Windows also are one of the avenues through which, even when closed, noise enters an architectural structure. There has been consistent and varied approaches to solving these problems. For instance in U.S. Pat. No. 5,027,574 discloses a window structure using a low thermal conductivity gas at a relatively low pressure so as decrease the amount of loss of heat due to convection.

U.S. Pat. No. 4,679,250 is directed to a window assembly that also includes a space in the structure for the inclusion of heating means, but it is really directed to state of the art heating means that do not heat through the window itself.

Clearly multi-pane windows have been known and used extensively, however, heretofore their use has depended upon certain known thermally non-conductive gases. These windows have been designed to act passively and only to insulate.

SUMMARY OF THE INVENTION

The present invention relates to improved window structures that provide improved thermal insulation by having provided for by the use of two hermetically sealed chambers formed by three panes of glass. The first of these chambers is disposed to the face of the window facing outwards and is filled with a gas that is low-heat conductive, the second chamber is disposed on the face of the window that is to be disposed towards the inside of the architectural unit and is filled with a heat conductive gas. The second chamber also has a heat generating means disposed therein to heat the conductive gas in the chamber.

OBJECTIVES OF THE INVENTION

The objective of this invention is to provide a more effective insulating window for both heat insulation and sound insulation. Another objective of the invention is to provide effective heating through a window. Another objective is to provide a combination of active and passive heating through an improved window design.

DETAILED DESCRIPTION OF THE INVENTION

Figure 1:
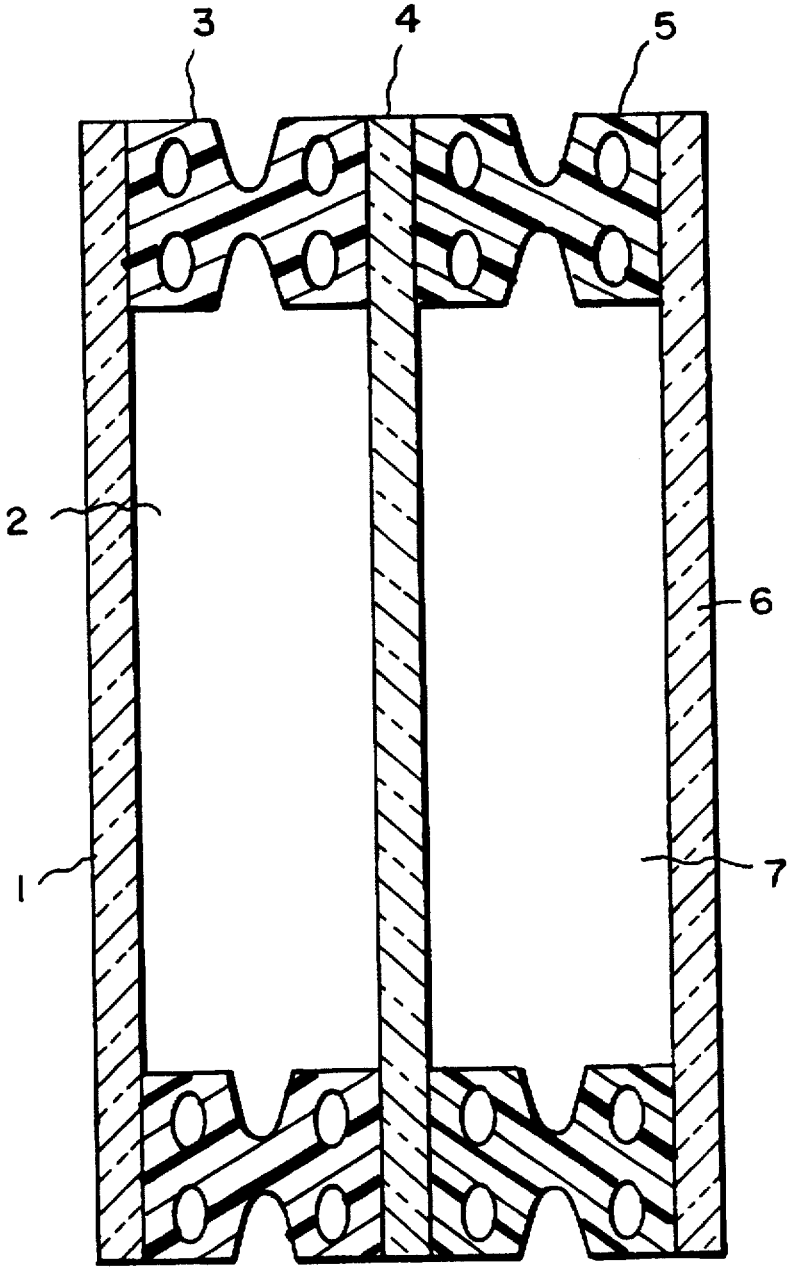
FIG. 1 is a cross-sectional view of a state of the art multipane window.
Figure 2:
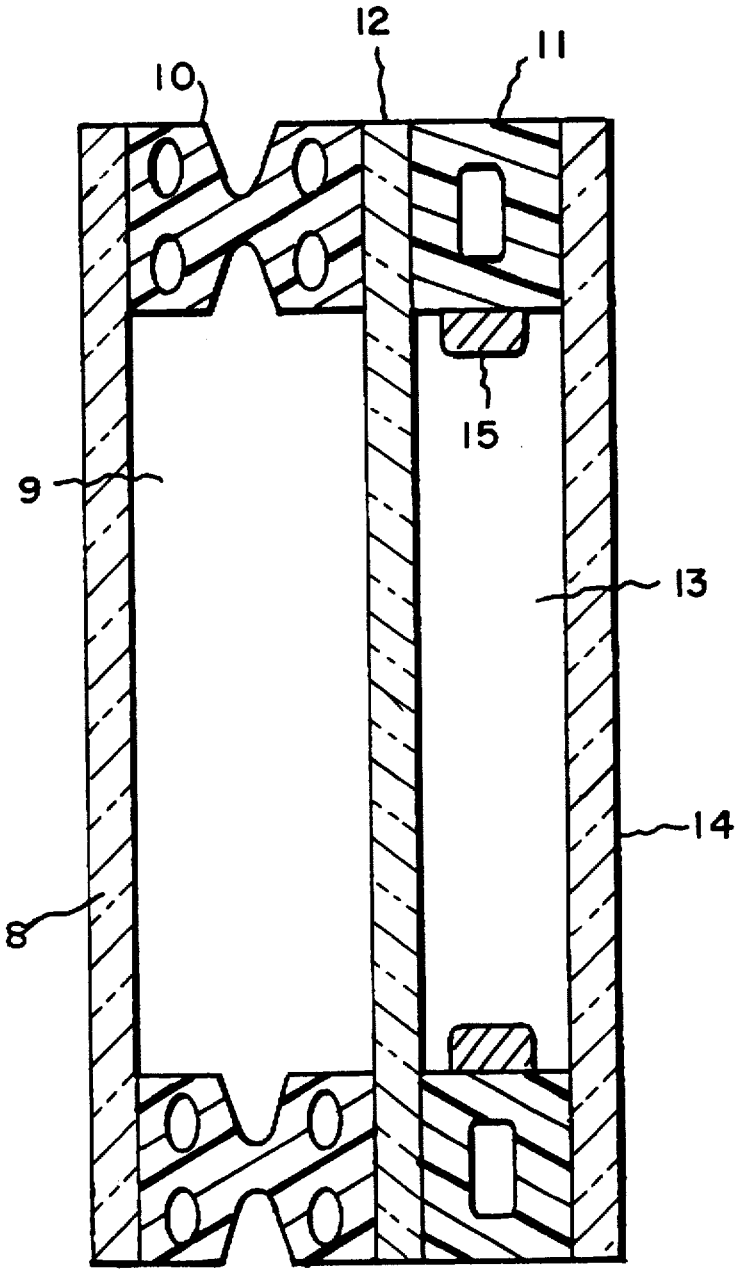
FIG. 2 is a cross-sectional view of one embodiment of the invention.
Figure 3:
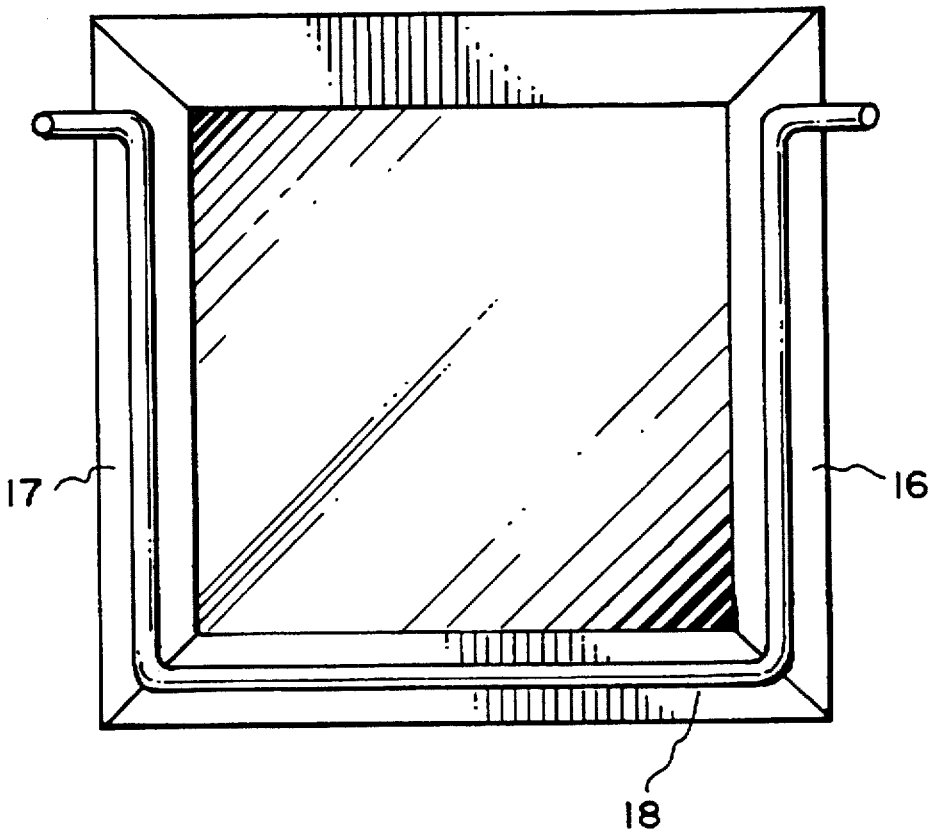
FIG. 3 is a view of one embodiment of the invention showing the preferred heating means configuration.

The present invention provides a window construction that is passively an effective heat and sound insulator and is also capable of actively heating the inside of the room or architectural space it installed in. In general the structure of the invention has at least two chambers, formed by three panes of glass. The chamber on the portion of the window to be faced towards the outside to the outside of the window is filled with a heat insulative gas and provides the primary passive thermal insulation for the invention. The second chamber formed by two panes of glass faces towards the inner portion of the window assembly and is filled with a heat conductive gas or gas mixture. This second chamber also is provided with a heat generating means that can be used to actively heat the gas mixture and provide a source for heating the interior portion of the architectural space where the invention is installed.

The state of the art window is formed by an outside pane of glass 1, a spacer means 3 disposed between the outside pane and a second pane 4 to form a first insulating area 2, and in some instances a third pane of glass 7 is used with a second spacer means 5 to form a second insulating area 6. In one embodiment of the present invention a window comprises a first structural glass pane 8 with a first spacer means 10 disposed between said first structural glass pane and an intermediate glass pane 12 thus forming a first reservoir 9 filled with a heat and sound insulating gas; a second structural glass pane 14 and a second spacer means 11 disposed to form a second reservoir 13 with said intermediate glass panel, said second reservoir being filed with a heat conductive gas; and a heating means 15 disposed within the second reservoir.

Of course the invention can also have further panes of glass forming additional reservoirs. These reservoirs can be used to increase the insulation rating of the window or to add additional sound deadening characteristics to the window.

The panes of glass can be made from state of the art glasses used in windows. These glasses may be treated with films to improve their toughness or reflectivity. Such coatings include polymer coatings, glass treatments, thin film depositions and the like.

The heating means employed in the present invention includes resistance heating, thermoelectric, heat transfer and any other state of the art means. In a preferred embodiment the heating means should be disposed on the border 15 of the window and along the side borders 16 of the frame 17 of the window. This embodiment will cause heat to be uniformly distributed across the whole window. A particularly effective means for heating is by providing a low voltage heating resistance strip along adjacent to the spacing means along the bottom edge of the window assembly 18.

The gases used in the outer reservoir of the window should be relatively low-heat conductive. Such gases are well known in the art and include halocarbon-11, halocarbon-113, halocarbon-114, halocarbon-116, sulfurhexafluoride and Xenon. The gas should be provided in the reservoir at about normal pressure, and of course the sealing means employed between the first structural glass pane and the intermediate glass pane must seal the reservoir hermetically.

Likewise the gas or gas mixture used in the second reservoir should be relatively heat conductive. Such gases include but are not limited to helium, neon, oxygen, hydrogen, and nitrogen, and mixtures thereof. The gas or gas mixtures should be supplied at about normal atmospheric pressure. Again the sealing means used to form the second reservoir between the second structural glass pane and the intermediate glass pane should seal the tow panes hermetically. The sealing means used to form the reservoirs can be state of the art spacers used in conjunction with known state of the art elastomeric adhesives. Such adhesives include silicone adhesives commercially available such as Torr Seal brand adhesives available from Varian Associates, Inc.. Other adhesives such as hot melt adhesives may also be employed as those skilled in the art are aware.

The spacers should position the panes of glass parallel to one another. Generally the gaps between the first structural pane and the intermediate pane forming the first reservoir should be in the range of about 0.25 to 0.65 inches. The spacing between the second structural pane and the intermediate pane forming he second reservoir should be about 0.10 to about 0.35 inches.

What is claimed is:

1. An improved thermally efficient window comprising:

a first structural glass pane with a first spacer means disposed between said first structural glass pane and an intermediate glass pane thus forming a first reservoir filled with a heat and sound insulating gas;

a second structural glass pane and a second spacer means disposed to form a second reservoir with the intermediate glass panel, said second reservoir being filled with a heat conductive gas;

a heating means disposed within the second reservoir.

2. The window of claim 1 wherein said first reservoir is formed by said first structural glass pane and said intermediate glass pane being disposed about 0.25 to 0.65 inches apart.

3. The window of claim 1 wherein said second reservoir is formed by the second structural glass pane and the intermediate glass pane being disposed up to about 0.3 inches apart.

4. The window of claim 2 wherein said heat and sound insulative gas is chosen from the group of gases consisting of halocarbon-11, halocarbon-113, halocarbon-114, halocarbon-116, sulfurhexafluoride and xenon.

5. The window of claim 3 wherein the gas is chosen from the heat conductive gases of the group consisting of helium, neon, oxygen, hydrogen, and nitrogen.

6. The window of claim 1 wherein the heating means is disposed on a lower border of said second reservoir.

7. The window of claim 4 wherein said insulative gas is xenon.

* * * * *